US005976031A

United States Patent [19]

Johnson

[11] Patent Number: 5,976,031

[45] Date of Patent: Nov. 2, 1999

[54] GOLF CLUB FITTING APPARATUS

[76] Inventor: Jeffrey B. Johnson, 1540 Chateauwood Dr., Clearwater, Fla. 33764

[21] Appl. No.: 08/947,889

[22] Filed: Oct. 9, 1997

Related U.S. Application Data

[51] Int. Cl.[6] ..... A63B 53/16

[52] U.S. Cl. ..... 473/300; 473/307; 473/316

[58] Field of Search ..... 473/300, 303, 473/305, 307, 308, 549, 568, 316, 322, 298, 299

[56] References Cited

U.S. PATENT DOCUMENTS

| | | | |
|---|---|---|---|
| 1,617,972 | 2/1927 | Wallace | 473/300 |
| 4,662,415 | 5/1987 | Proutt | 473/300 X |
| 4,878,667 | 11/1989 | Tosti | 473/300 |
| 5,123,646 | 6/1992 | Overby et al. | 473/298 |
| 5,390,921 | 2/1995 | De Ruyter | 473/299 |
| 5,442,209 | 8/1995 | Benzel | 473/297 |
| 5,513,844 | 5/1996 | Ashcraft et al. | 473/288 |
| 5,611,533 | 3/1997 | Williams | 473/568 |
| 5,653,645 | 8/1997 | Baumann | 473/305 |

*Primary Examiner*—Kien T. Nguyen
*Attorney, Agent, or Firm*—David Kiewit

[57] ABSTRACT

Apparatus for fitting a golf club to an individual player comprises a plurality of shaft extension plugs that fit into the upper end of a club shaft so as to provide various effective shaft lengths. A removable elastomeric grip, configured as a tube having a closed end and a slit extending from the open end to a point near the closed end, is slid over the shaft and whatever extension plug is inserted into it. The inner diameter of grip is matched to the outer diameter of the shaft, and the inner surface of the grip is smooth. This arrangement provides a maximum contact area between the grip and the shaft in order to keep the shaft fro sliding out the grip when the player swings the try-club. One of the advantages of this arrangement is that it reduces the number of individual items of equipment that a fitting dealer needs to stock in order to cover a full range of performance parameters.

2 Claims, 2 Drawing Sheets

GOLF CLUB FITTING APPARATUS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The invention relates to method and apparatus for selecting a golf club most appropriate to a predetermined individual.

2. Description of Prior Art

Fitting an individual golfer with an optimal club can employ a large and expensive inventory of equipment to allow the individual to try various combinations of grip, shaft, and head parameters for a given club. The grip parameters include at least the grip diameter and style. The shaft parameters include at least length, flex point, weight and stiffness. The head parameters may include head weight, head weight distribution, face angle, the angle it which the shaft is mated to the head, and a choice between right-handed and left-handed arrangements. Although each of these variables has a continuous range of values, it is common practice in the manufacture of golf clubs to provide a number of discrete pre-selected values for the most significant of them—for example, there arc five standard shaft stiffnesses, conventionally denoted in the golf equipment art by the letters X, S, R, A, and L, respectively. Even though this use of a restricted number of predetermined values for various parameters renders the number of permutations of possible club configurations finite, the number is still so large as to make it practically impossible for a golf club dealer to address the matter of fitting a golfer with a club by stocking one of every possible different club. As an example, consider a conventional arrangement that bypasses some of the choices by selecting a shaft model and a grip style, carefully fitting a five iron to a golfer, and then using data from that fitting to define an entire set of clubs. To follow this practice exhaustively, one could construct three thousand different clubs using .five values of shaft flexion, four conventional lengths, five grip sizes, three lie angles, five swing weights and providing both right and left handed models.

Notable among prior art patents in this area are:

U.S. Pat. No. 5,611,533, wherein Williams teaches a gripping sleeve for a sporting implement, the sleeve having a longitudinal slit and having an abrasive coating on its inner surface.

U.S. Pat. No. 5,513,844, to Ashcraft et al., who teach a try-club arrangement in which one of a number of shafts can be releasably attached to a selected club head. Their arrangement comprises a threaded hosel sleeve attached to the head by means that may include a screw running along the axis of the shaft, but that also has a clamp attaching the head to the shaft.

U.S. Pat. No. 5,244,209, wherein Benzel shows a golf club grip apparatus enabling a golfer to vary the swing weight of a club by adding weights to a hollow cylinder inserted into the end of the club shaft. Benzel's cylinder is essentially a permanent insert accessed through a cap at the end of the shaft. Benzel does not use removable grips.

SUMMARY OF THE INVENTION

It is an object of the invention to provide new and improved apparatus and method for fitting a golf club to an individual player. More specifically, it is an object of the invention to provide such apparatus and method where the improvement comprises a reduction in the number of individual items of hardware and equipment that a fitting dealer needs to stock in order to cover a full range of performance parameters.

One aspect of the invention has as an object the provision of apparatus and method whereby an individual can test a variety of different club grips (e.g., each having a unique and different outer diameter) using what he or she perceives to be otherwise the same club. Another aspect of the invention has as an object the provision of apparatus and method whereby an individual can test a variety of shaft lengths and stiffness. Yet another aspect of the invention has as an object the provision of apparatus and method whereby an individual can test a variety of club heads, club head weights and club head lie angles.

The invention provides a plurality of golf club shafts and a second plurality of shaft extensions. By using various combinations of shafts and of extensions, one can cover the full range of shaft lengths and stiffnesses while having far fewer shafts and fewer total parts than would be required if the extensions were not employed. In one embodiment of the invention a reduction of fifteen has been achieved in the number of shafts that needs to be carried in inventory for each shaft style that is offered.

The invention provides a plurality of grips that can be removably installed on a golf club shaft so that a player can test grips having various outer diameters, degrees of resilience, and surface designs and textures. These removable grips cooperate with the shaft extensions so that the shaft length can be changed by removing the grip, inserting or removing a shaft extension, and replacing the grip. A preferred grip of the invention is a tubular elastomeric body having one closed end, the grip being conventional in appearance save for a longitudinal slit extending along one side from the open end of the tube to a point near the closed end. The inner diameter of the grip is chosen to closely match the outer diameter of the club shaft, and in a preferred embodiment, is selected to be equal thereto within manufacturing tolerance limitations. The inner surface of the grip is smooth, so as to provide maximum contact area between the grip and the club shaft. This arrangement has been found to not only provide a grip that can be easily slid onto and off of the shaft, but to also provide a grip that does not slide about while the player is swinging the try club.

The invention provides a plurality of club heads as well as several threaded attachment arrangements allowing a selected head to be removably attached to a selected shaft. In one embodiment, a connecting member having a left-handed thread on one end and a right-handed thread on the other end is employed to allow a selected head to be screwed firmly to one of the shafts—i.e., turning the head in a clockwise direction tightens both the threaded connection between the head and the connecting member and the threaded connection between the connection member and the shaft. In another embodiment two connecting members attached respectively to the shaft and to the club head, and configured so as to prohibit club head rotation during the attachment process and drawn into engagement by screw extending through the club head along the shaft axis.

DETAILED DESCRIPTION OF THE PREFERRED EMBODIMENT

Figure 1:
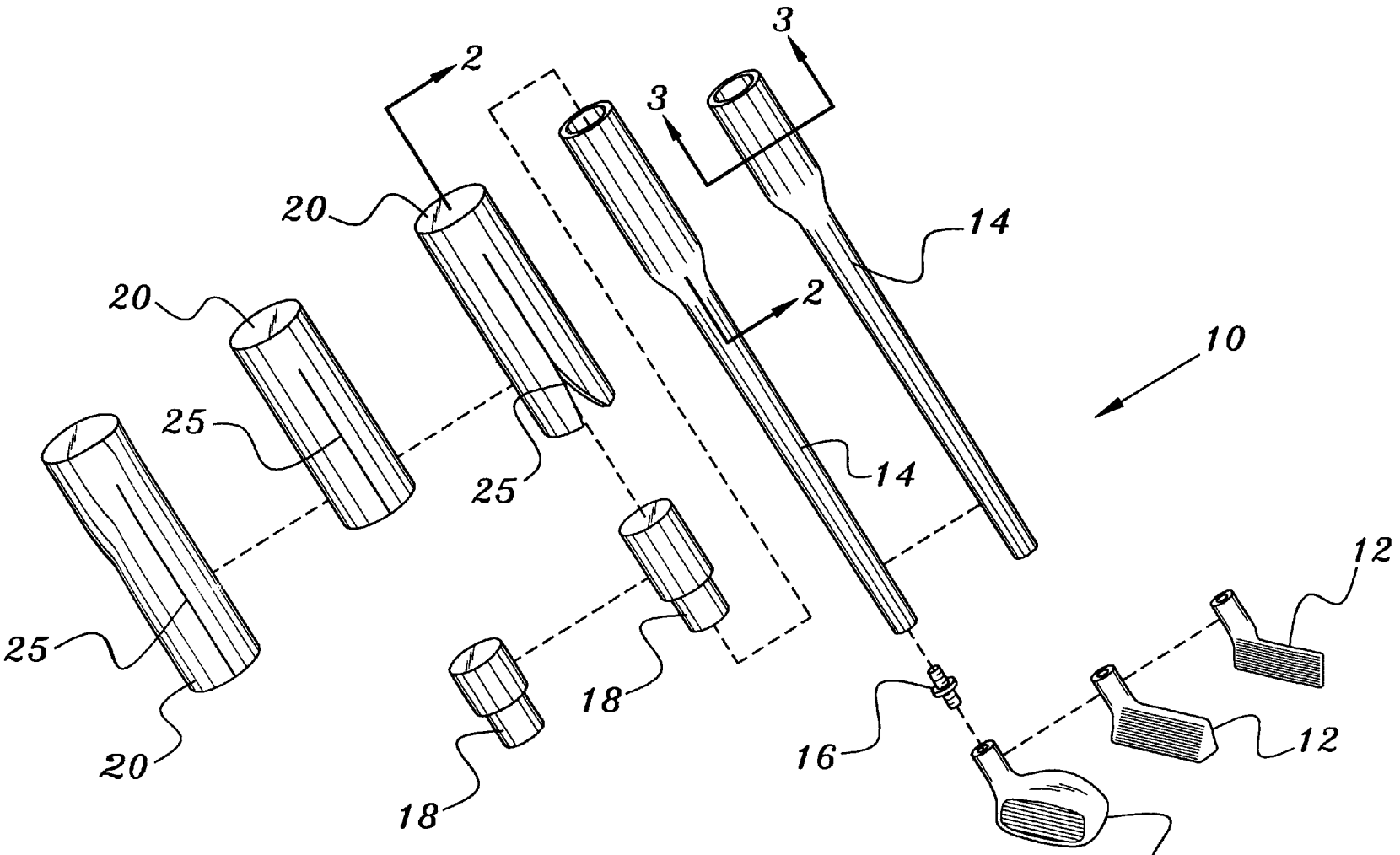
FIG. 1 is an exploded elevational view of a golf club fitting apparatus of the invention

Preferred golf club fitting apparatus 10 of the invention comprises a plurality of club heads 12, a plurality of tubular shafts 14, a connecting means for connecting one of the heads to one of the shafts 16, a plurality of extension plugs 18 for increasing the length of one of the shafts and a plurality of grips 20. In one embodiment of the invention the inventor has succeeded in covering a complete range of selectable parameters with apparatus comprising six heads, fourteen shafts per shaft style, eighteen extension plugs, and five grips.

Figure 2:
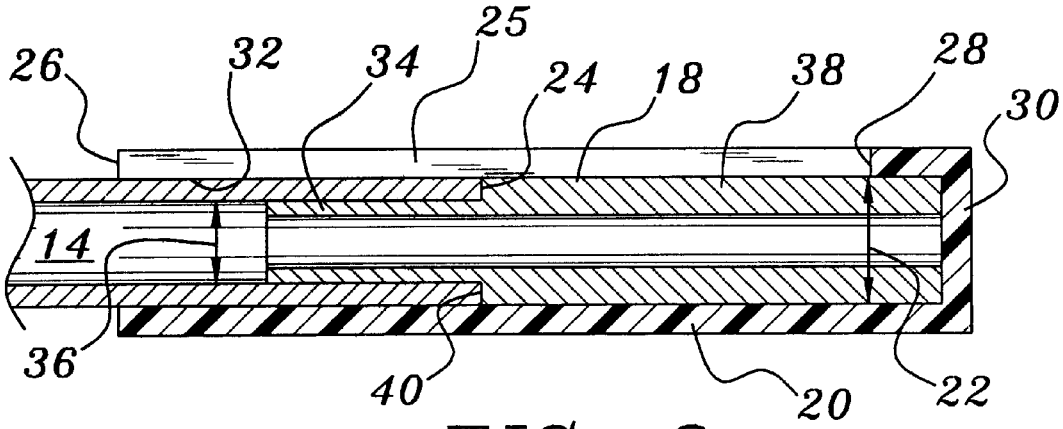
FIG. 2 is a cross sectional view of the grip end of a golf club shaft, the view taken as indicated by the double-headed arrow 2—2 of FIG. 1, the view showing an extension plug inserted into the shaft and covered by a removable grip.
Figure 3:
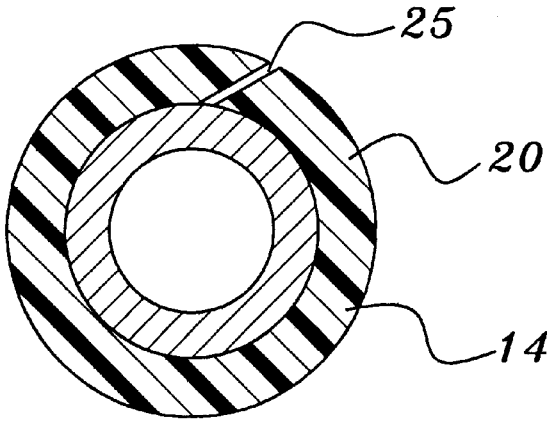
FIG. 3 is a cross-sectional view of the grip end of the shaft, the view taken perpendicular to that of FIG. 2, the view indicated by the double headed arrow 3—3 of FIG. 1.

Each of the grips 20 in the preferred embodiment is a closed-end tube having an inner diameter 22 equal to or slightly less than the outer diameter of the upper end 24 of a shaft 14, which may have a plurality of stepped regions of differing diameter. The "upper end" as herein used is that end of the shaft proximal the grip, while the opposite, "lower end" of the shaft is adjacent the club head. Each grip 20 has a single longitudinal slit 25 parallel to its axis and running from the open end 26 of the grip 20 to a point 28 adjacent the closed end 30 of the grip 20. The slit 25 may lie along a radius of the shaft (e.g., as depicted in FIG. 2) or it may be skewed with respect to a radius, as depicted in FIG. 3. In either event, the slit 25 is configured to be nearly imperceptible to the golfer when the grip is installed on the shaft, and is long enough to make installing the grip 20 on the shaft 14 easy.

The grip 20 is preferably made of a rubber or other elastomer having an inner surface 32 that is preferably smooth. When installed on a shaft 14, the preferred smooth surface 32 provides a maximum of contact area between the grip 20 and the outer surface of the shaft 14. This maximization of the contact surface area has been found to be effective in preventing relative sliding motion between grip and shaft. That is, the preferred arrangement provides a try club that a golfer can use for test swings without having the shaft slide within the grip.

A complete try club set 10 may comprise, for example, five to ten different grips 20. These grips differ principally in their outer diameter 34 but may also be made of different materials having differing resiliencies and different patterns of ridges and grooves on the outer surfaces thereof. Generally speaking, the try club grips 20 of the invention are made to cover the same range of Shore Hardness values as is encountered in contemporary injection molded grips.

A shaft extension plug 18 may be inserted into the upper end 24 of a shaft 14 in order to increase the effective length of the club and to change the overall weight and flexibility of the try club. It has been found that in fitting a golfer for a club (e.g., a five iron) having a chosen shaft style, a selection of eighteen extensions having one of three predetermined lengths (one half, one, and one and one half inches, respectively) and fourteen shafts is satisfactory for covering the full range of shaft parameters. As noted supra, the prior art approach of using a separate shaft for each tested combination, on the other hand, required an inventory of three thousand clubs for this purpose.

The extension plug 18, as depicted in FIG. 2, comprises a first, narrow, portion 34 that has a outer diameter substantially equal to the inner diameter 36 of the tubular shaft so that it fits snugly therein. The plug 18 also has a second, wider, portion 38 that has substantially the same diameter 22 as the outside of the shaft 14. The two portions 34, 38 are separated by a sharp shoulder 40 that butts against the upper end 24 of the shaft 14 when the plug 18 is installed therein. It is noted that although the preferred extension is a hollow tube having a single radius along its length (i.e., as depicted in the drawing), one could also consider plural internal diameters in a single extension, solid extensions, etc.)

Figure 4:
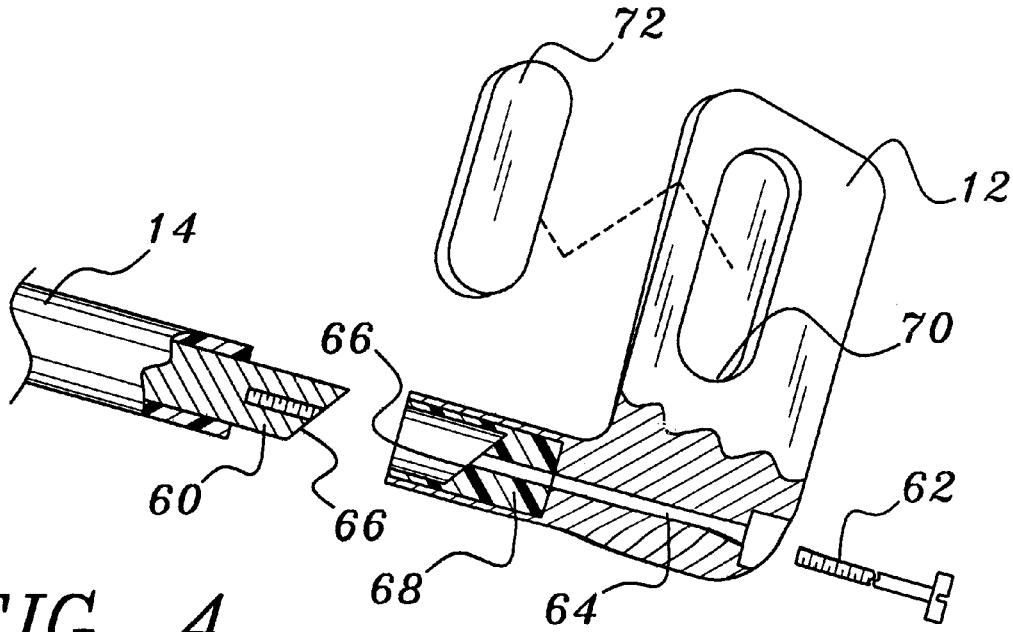
FIG. 4 is a partly cut away detailed view of an arrangement for connecting a shaft to a club head.

Turning now to FIG. 4, one finds a depiction of one arrangement for releasably attaching a head 12 to a shaft 14 by using an internally threaded connecting member 60 adhesively bonded to the shaft 14. A screw 62 inserted through a hole 64 in the sole of a club head 12 engages the threaded connecting member 60 to draw the head 12 firmly into engagement with the shaft 14. To prevent the head from rotating relative to the shaft when the screw is tightened, a preferred connecting arrangement of this sort provides mating anti-rotation elements 66 on the connecting member 60 and on a hosel plug 68. The anti-rotation elements 66 may be simply slanted faces, as depicted in FIG. 4, or may comprise other known structures such as combinations of notches and cooperating detents into which the notches may fit. The hosel plug 68, in a preferred configuration, is formed by reaming out the hosel 50 of a club, filling the cavity so formed with an epoxy resin, drilling a snug clearance throughhole for the screw 62, and then reaming out a portion of the hole so as to form a cavity for the insertion thereinto of the lower end of the threaded connecting member 60.

Other connecting means may also be employed for removably attaching the head 12 to the shaft 14. For example, one could tap an internal thread into the hosel and tap an internal thread having the opposite sense (i.e., one of the two is a right-handed thread, the other is a left handed thread) into the shaft 14. A connector 16 having two cooperating male threaded portions can then be used to join the shaft and head. The connector 16 comprises an upper left-hand threaded portion that can be engaged by the internal shaft thread, a lower right-hand threaded portion that can be engaged by the internal hosel thread and a central knurled portion having an axial extent long enough that it can be comfortably held and manipulated by the person changing clubs and heads. It may be noted that the use of both thread senses on the connector ensures that the same twisting motion that tightens the head 12 to the connector 16 also tightens the connector 16 to the shaft 14.

Another aspect of the try club arrangement is a provision for changing the swing weight of a club head. In a preferred embodiment a cavity 70 is formed in the back of a ferromagnetic golf club head 12 and a permanent magnet 72 is inserted therein to add weight to the head. Thus, the preferred golf club fitting apparatus comprises a means of selecting a club head with a preferred swing weight by magnetically attaching one or more of a plurality of permanent magnet weighting members 72, each of which has a unique weight, to a golf club head having a ferromagnetic portion. It may be noted that variations on this approach, for use if the head 12 is formed of a non-ferromagnetic material, comprises embedding a ferromagnetic liner in the cavity 70 or a ferromagnetic slug of material in the bottom of the cavity—i.e., closer to the face of the club than is the bottom of the cavity 70. Other arrangements for adding weight to the club head comprise welding studs (not shown) to the back of a club head, and then fastening a weight to the club head by means of those studs and nuts (not shown).

Although the present invention has been described with respect to several preferred embodiments, many modifications and alterations can be made without departing from the invention. Accordingly, it is intended that all such modifications and alterations be considered as within the spirit and scope of the invention as defined in the attached claims.

We claim:

1. Apparatus for fitting a golf club to a golfer, the apparatus comprising:

a first plurality of tubular golf club shafts, each of the shafts comprising means adjacent a lower end thereof to releasably attach one of a second plurality of golf club heads thereto;

a third plurality of removably insertable cylindrical extension plugs, each plug respectively comprising a smaller diameter portion and a larger diameter portion, the smaller diameter portion of a predetermined one of the plugs snugly fitting into the upper end of a predetermined one of the shafts, the larger diameter portion of the predetermined one of the plugs having the same outer shaft diameter as that tubular shaft into which it fits, whereby the effective length of the predetermined one of the shafts is extended by the insertion thereinto of the predetermined one of the plugs; and a fourth plurality of grips each grip comprising a respective elastomeric tube having one open end one closed end, and a longitudinal slit extending from the respective open end to a point adjacent the respective closed end a predetermined one of the grips having an inner diameter equal to the outer shaft diameter of the predetermined one of the shafts, whereby the predetermined one of the grips is adapted to be removably disposed about the predetermined shaft.

2. The apparatus of claim 1 wherein the slit is skewed with respect to a radius of the shaft.

* * * * *

UNITED STATES PATENT AND TRADEMARK OFFICE

CERTIFICATE OF CORRECTION

PATENT NO. : 5,976,031
DATED : Nov. 2, 1999
INVENTOR(S) : Jeffrey B. Johnson

It is certified that error appears in the above-identified patent and that said Letters Patent is hereby corrected as shown below:

In column 6, line 8, after "first plurality of grips" insert a comma.

In column 6, line 9, after "tube having one open end" insert a comma.

In column 6, line 12 after the first word "end" insert a comma.

Signed and Sealed this

Tenth Day of October, 2000

*Attest:*

*Attesting Officer*

Q. TODD DICKINSON

*Director of Patents and Trademarks*